US009597908B2

(12) United States Patent
Kanda

(10) Patent No.: US 9,597,908 B2
(45) Date of Patent: Mar. 21, 2017

(54) PRINTER DISPLAYS HEATING ELEMENTS STATUS AND SETS A CHECK RANGE TO DETERMINE WHETHER THE HEATING ELEMENTS IS NORMAL OR ABNORMAL

(71) Applicant: Brother Kogyo Kabushiki Kaisha, Nagoya-shi, Aichi-ken (JP)

(72) Inventor: Mitsuhiro Kanda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/836,593

(22) Filed: Aug. 26, 2015

(65) Prior Publication Data

US 2016/0089917 A1 Mar. 31, 2016

(30) Foreign Application Priority Data

Sep. 29, 2014 (JP) ..... 2014-198051

(51) Int. Cl.
*B41J 29/393* (2006.01)
*B41J 2/32* (2006.01)
*B41J 2/355* (2006.01)

(52) U.S. Cl.
CPC ..... *B41J 29/393* (2013.01); *B41J 2/32* (2013.01); *B41J 2/355* (2013.01)

(58) Field of Classification Search
CPC ..... B41J 2/335; B41J 2/33515; B41J 3/4075
See application file for complete search history.

(56) References Cited

FOREIGN PATENT DOCUMENTS

JP 2006-044027 A 2/2006
JP 2007-144841 A 6/2007

OTHER PUBLICATIONS

Asanuma et al.; "Printer and Method of Prinitng"; JP Pub date Feb. 16, 2006 and JP Pub No. 2006-044027.*
Tanitoshi Atsushi; "Printer"; JP Pub date Jun. 14, 2007 and JP Pub No. 2007-144841.*

* cited by examiner

*Primary Examiner* — Benny Q Tieu
*Assistant Examiner* — Haris Sabah
(74) *Attorney, Agent, or Firm* — Banner & Witcoff, Ltd.

(57) ABSTRACT

A printer includes a printing portion, a display, and a processor. The printing portion includes a plurality of heating elements arrayed in a specified direction. The printing portion is configured to perform printing on a print medium. The display is configured to display an image. The processor is configured to cause the display to display a first image, the first image being an image that shows the plurality of heating elements, receive specification of a check range, the check range being a range that includes a heating element to be checked among the plurality of heating elements, check, in a case where the specification of the check range is received, a state of the heating element included in the check range, and cause the display to display a check result of the state of the heating element.

16 Claims, 18 Drawing Sheets

PRINTER DISPLAYS HEATING ELEMENTS STATUS AND SETS A CHECK RANGE TO DETERMINE WHETHER THE HEATING ELEMENTS IS NORMAL OR ABNORMAL

CROSS-REFERENCE TO RELATED APPLICATION

This application claims priority to Japanese Patent Application No. 2014-198051 filed Sep. 29, 2014, the content of which is hereby incorporated herein by reference.

BACKGROUND

The present disclosure relates to a printer that is configured to perform printing on a print medium using heating elements.

A printer is known that includes a thermal head including a plurality of heating elements. The printer energizes the heating elements and causes the heating elements to generate heat, thus performing printing on a print medium. For example, a known printer can set a range that includes some of the plurality of heating elements of the thermal head, as a check range. The printer can determine whether the heating element included in the check range is good or not.

SUMMARY

The above-described printer can set a range, of the thermal head, that is frequently used, as the check range. However, with the above-described printer, a user cannot freely set a check range. Therefore, the printer may not check a state of the heating element included in the range desired by the user.

Embodiments of the broad principles derived herein provide a printer that is capable of checking a state of a heating element included in a range desired by a user.

Embodiments provide a printer that includes a printing portion, a display, and a processor. The printing portion includes a plurality of heating elements arrayed in a specified direction. The printing portion is configured to perform printing on a print medium. The display is configured to display an image. The processor is configured to cause the display to display a first image, the first image being an image that shows the plurality of heating elements, receive specification of a check range, the check range being a range that includes a heating element to be checked among the plurality of heating elements, check, in a case where the specification of the check range is received, a state of the heating element included in the check range, and cause the display to display a check result of the state of the heating element.

BRIEF DESCRIPTION OF THE DRAWINGS

Embodiments will be described below in detail with reference to the accompanying drawings in which.

DETAILED DESCRIPTION

Figure 1:
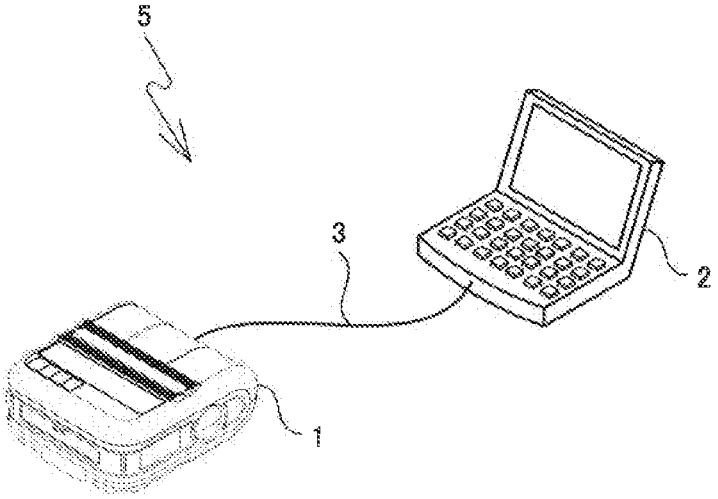
FIG. 1 is a diagram showing an overview of a printing system.

Embodiments will be explained with reference to the drawings. An overview of a printing system 5 will be explained with reference to FIG. 1. The printing system 5 includes a printer 1 and an external terminal 2. The printer 1 and the external terminal 2 are connected by a USB (registered trademark) cable 3. The printer 1 is configured to print information on a heat sensitive tape 8 (refer to FIG. 3), which is a print medium. The print information includes a character (a letter, a numeral, a symbol, and the like), a graphic, a barcode, a two-dimensional code, and the like.

In the present embodiment, the printer 1 is configured to print the print information on the heat sensitive tape 8 based on print data that is received from the external terminal 2. The external terminal 2 is, for example, a general purpose personal computer (PC). The external terminal 2 is configured to create the print data for the printer 1 to print the print information. A user may edit the print data via an input device, such as a keyboard, a mouse or the like of the external terminal 2.

The structure of the printer 1 will be explained with reference to FIG. 2 to FIG. 4. In the explanation below, the lower right side, the upper left side, the upper right side, the lower left side, the upper side, and the lower side of FIG. 2 are respectively defined as the right side, the left side, the rear side, the front side, the upper side, and the lower side of the printer 1.

Figure 2:
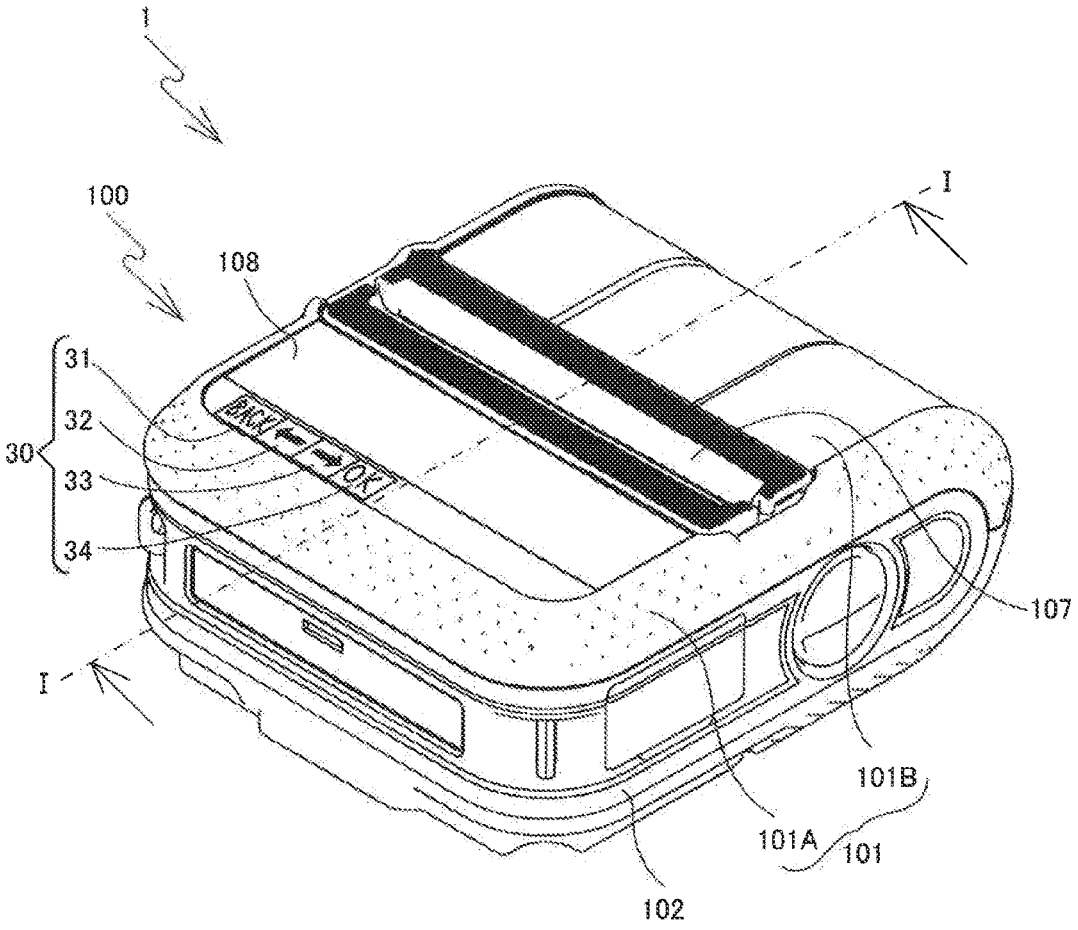
FIG. 2 is a perspective view of a printer.

As shown in FIG. 2, the printer 1 includes a housing 100. The housing 100 has a substantially box shape. The housing 100 includes a top cover 101 and an undercover 102. The top cover 101 is provided on the upper surface of the housing 100. The undercover 102 is provided on the lower surface of the housing 100. The top cover 101 includes a fixed portion 101A and an opening/closing lid 101B. The fixed portion 101A is a front section of the top cover 101. The opening/closing lid 101B is a rear section of the top cover 101.

A BACK key 31, a left arrow key 32, a right arrow key 33 and an OK key 34 are provided on the front left side of the upper surface of the fixed portion 101A. The BACK key 31, the left arrow key 32, the right arrow key 33, and the OK key 34 are arranged side by side in this order from the left to the right. In the explanation below, when the BACK key 31, the left arrow key 32, the right arrow key 33, and the OK key 34 are collectively referred to, they are referred to as an operation portion 30. A display 108 is provided to the rear of the operation portion 30 on the upper surface of the fixed portion 101A.

Figure 3:
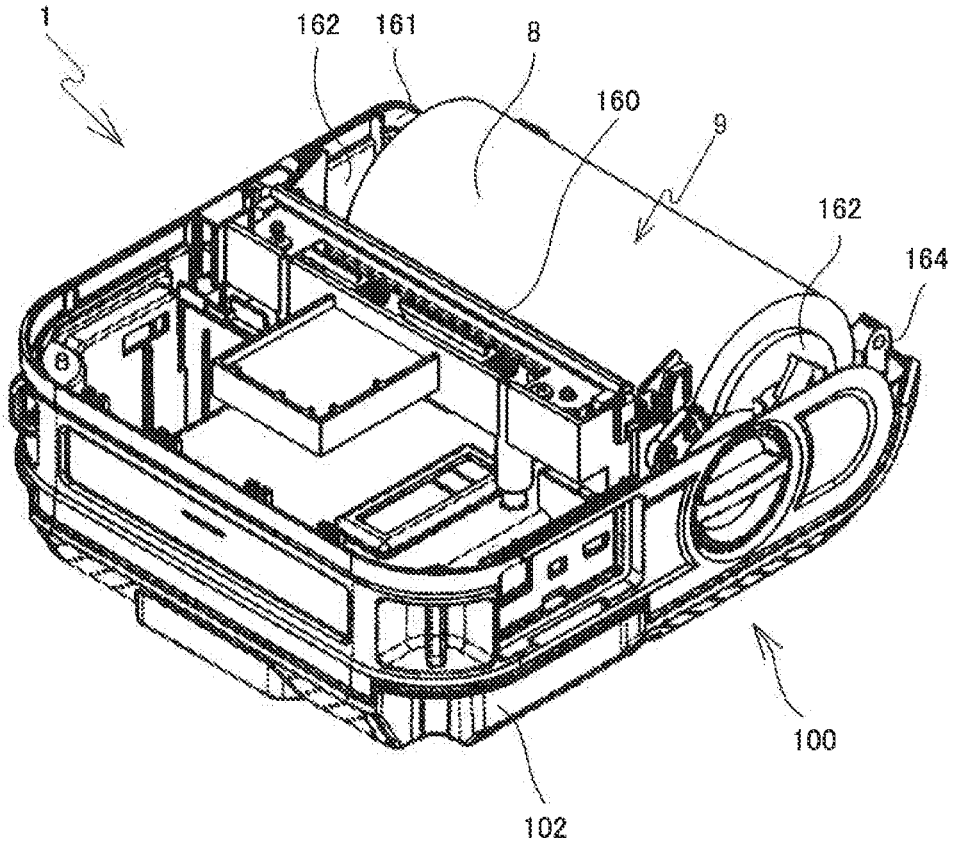
FIG. 3 is a perspective view of the printer in a state in which a top cover is removed.

As shown in FIG. 3, a roll housing portion 161 is provided below the opening/closing lid 101B (refer to FIG. 2). A roll 9 may be housed in the roll housing portion 161. The roll 9 is the wound heat sensitive tape 8. Support members 162 may be respectively attached to both end portions of the roll 9. The roll 9 may be rotatably supported by the support members 162. Thus, the printer 1 may continuously supply the heat sensitive tape 8 from the roll housing portion 161. The rear end of the opening/closing lid 101B is rotatably supported by a hinge portion 164. The front end of the opening/closing lid 101B may swing upward and downward with the rear end of the opening/closing lid 101B serving as an axis, and thus the opening/closing lid 101B may open and close. In an open state of the opening/closing lid 101B, the roll housing portion 161 is exposed. In this state, the user may easily mount and replace the roll 9.

Figure 4:
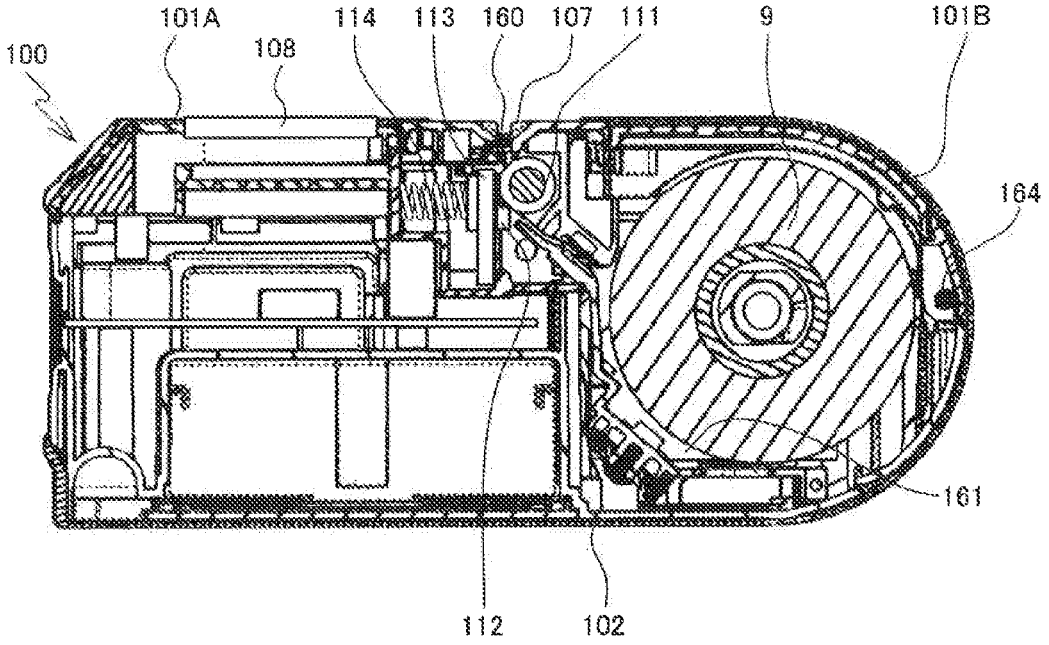
FIG. 4 is a cross-sectional view in the direction of arrows taken along a line I-I shown in FIG. 2.

As shown in FIG. 2 and FIG. 4, a discharge port 107 is provided in a substantially central portion in the front-rear direction of the top cover 101, between the fixed portion 101A and the opening/closing lid 101B. In the present embodiment, the discharge port 107 is close to the display 108. More specifically, the discharge port 107 is provided to the rear of the display 108 and in the vicinity of the display 108.

A printed section of the heat sensitive tape 8 may pass through the discharge port 107 and may be discharged from the inside to the outside of the housing 100. A platen roller 111 is rotatably supported on a front end portion of the opening/closing lid 101B. A drive motor 109 (refer to FIG. 5) is provided inside the housing 100. The drive motor 109 is connected to the platen roller 111 via a gear mechanism (not shown in the drawings). A CPU 11 (refer to FIG. 5) controls the drive of the drive motor 109 via a drive circuit 18 (refer to FIG. 5). When a rotational driving force of the drive motor 109 is transmitted to the platen roller 111, the platen roller 111 rotates.

A line thermal head 112, a plate 113, and a spring 114 are provided below a rear end portion of the fixed portion 101A. In a state in which the opening/closing lid 101B is closed, the platen roller 111 is disposed to the rear of the plate 113. The plate 113 extends in the left-right direction. The front surface and the rear surface of the plate 113 are flat surfaces. The line thermal head 112 is provided on the rear surface of the plate 113. The line thermal head 112 includes a plurality of heating elements that are arrayed in a specified direction. Hereinafter, the direction in which the plurality of heating elements of the line thermal head 112 are arrayed is referred to as a main scanning direction. In the present embodiment, the line thermal head 112 extends in the left-right direction. The plurality of heating elements are arrayed in the left-right direction. The plurality of heating elements is configured to generate heat by being energized. The spring 114 is provided on the front surface of the plate 113. The spring 14 urges the plate 113 to the rear.

A cutting blade 160 is provided above the line thermal head 112. The cutting blade 160 extends along the discharge port 107. The user may manually cut the heat sensitive tape 8 by pulling the heat sensitive tape 8 discharged from the discharge port 107 in the forward direction and by pressing the heat sensitive tape 8 against the cutting blade 160.

A process in which a label is created will be explained. The heat sensitive tape 8 may be inserted from the lower side to the upper side between the platen roller 111 and the line thermal head 112. The heat sensitive tape 8 may extend from the roll 9 housed in the roll housing portion 161. When the spring 114 urges the plate 113 to the rear, the line thermal head 112 may press the heat sensitive tape 8 against the platen roller 111 with a specified force. When at least some of the plurality of heating elements generate heat in this state, dots corresponding to the heating elements that have generated heat may be formed on the heat sensitive tape 8. Thus, the dots corresponding to one line may be printed on the heat sensitive tape 8. At the same time, the platen roller 111 may rotate in accordance with the rotation of the drive motor 109. Thus, the heat sensitive tape 8 may be fed out from the roll 9 and may be fed from the lower side to the upper side. Thus, one line of dots may be repeatedly formed on the heat sensitive tape 8, resulting in the printing of the print information.

The discharge port 107 is located on the downstream side of the platen roller 111 and the line thermal head 112, in a feed direction of the heat sensitive tape 8 during printing. The printed heat sensitive tape 8 may be discharged from the discharge port 107 to the outside of the housing 100. When the user pulls the discharged heat sensitive tape 8 in the forward direction and presses the heat sensitive tape 8 against the cutting blade 160, the heat sensitive tape 8 may be cut by the cutting blade 160. In this manner, the label may be created. The feed direction of the heat sensitive tape 8 is a direction that is different from the main scanning direction.

Figure 5:
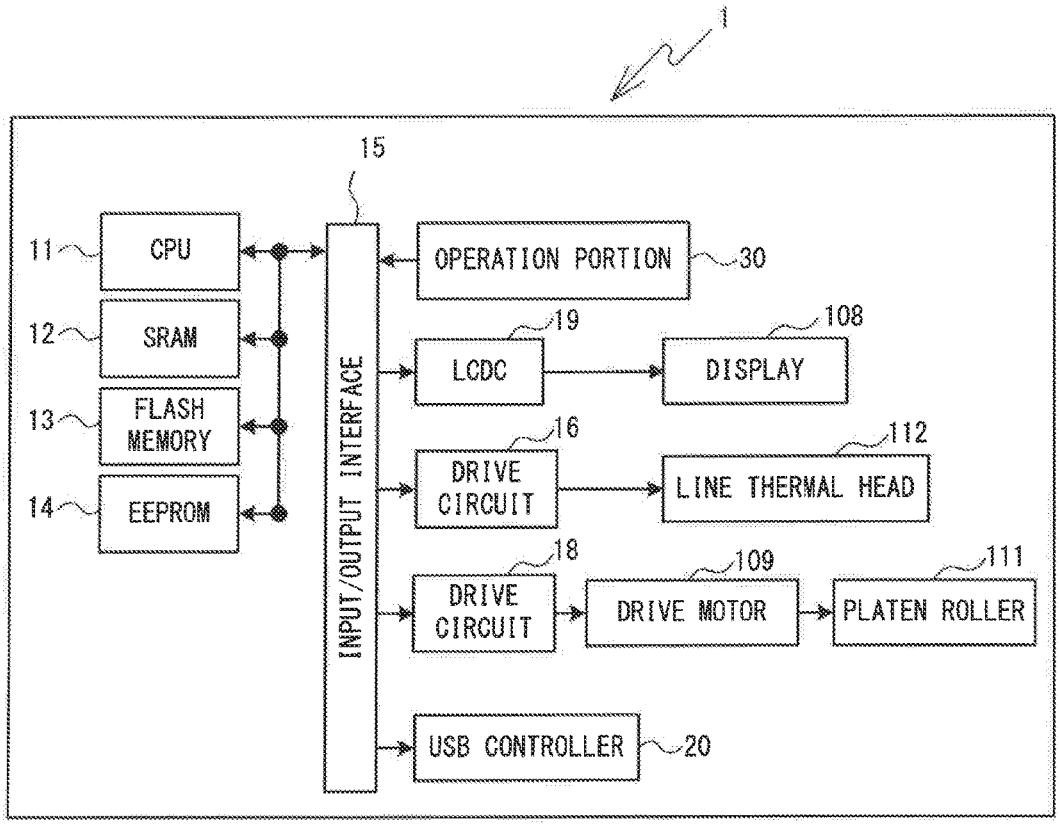
FIG. 5 is a block diagram showing an electrical configuration of the printer.

An electrical configuration of the printer 1 will be explained with reference to FIG. 5. The printer 1 includes the CPU 11, a SRAM 12, a flash memory 13, an EEPROM (registered trademark) 14, an input/output interface 15, and the like, which are connected via a data bus. The CPU 11 performs overall control of the printer 1. The SRAM 12 temporarily stores the print data received from the external terminal 2. The flash memory 13 is a rewritable nonvolatile storage element. The flash memory 13 stores various programs that are executed by the CPU 11 in order to control the printer 1. The input/output interface 15 transmits data and control signals. The EEPROM 14 is a nonvolatile storage element that stores various parameters and the like.

The operation portion 30, a liquid crystal drive circuit (LCDC) 19, a drive circuit 16, the drive circuit 18, a USB controller 20, and the like are connected to the input/output interface 15. The LCDC 19 includes a video RAM (not shown in the drawings) to output display data to the display 108. The drive circuit 16 is an electronic circuit to drive the line thermal head 112. The drive circuit 18 is an electronic circuit to drive the drive motor 109, which is configured to cause the platen roller 111 to operate. The USB controller 20 is a device to communicate with the external terminal 2 via the USB cable 3.

Specification of a check range will be explained with reference to FIG. 6 to FIG. 9. The check range is a range that includes a heating element to be checked among the plurality of heating elements. The user may specify the check range and thus may instruct the printer 1 to check a state of the heating element included in the check range. In the present embodiment, the user may specify one or more check ranges using the operation portion 30.

Figure 6:
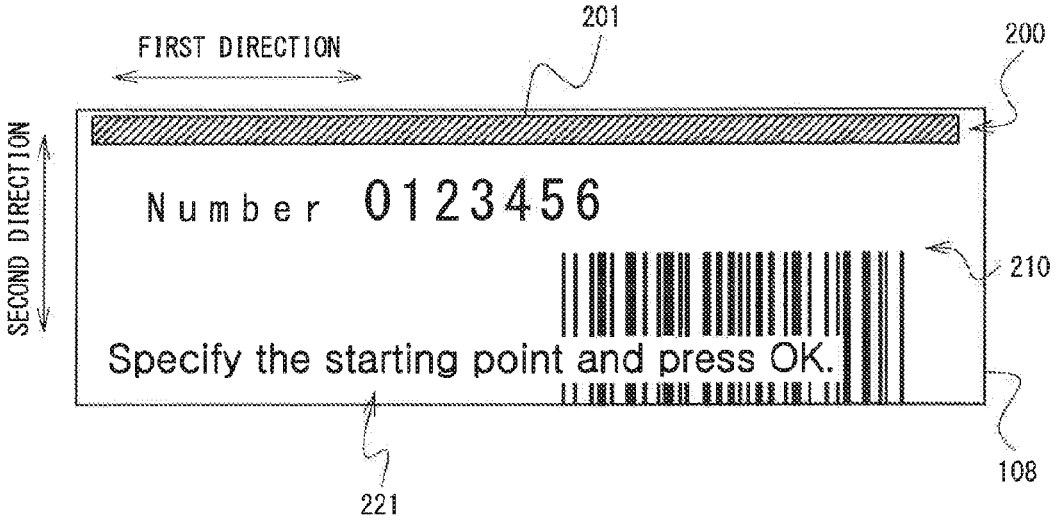
FIG. 6 is a diagram showing an image displayed on a display.

When the user instructs the printer 1 to perform head check processing, a head image 200 is displayed on the display 108, as shown in FIG. 6. The head check processing is processing to check the state of the heating element in the check range specified via the operation portion 30 and to display a check result on the display 108. In the present embodiment, in the head check processing, the printer 1 checks whether or not there is disconnection of the heating element. The head image 200 is an image that shows the plurality of heating elements. In the present embodiment, the plurality of heating elements shown by the head image 200 are arrayed in a first direction on the display 108. The first direction is the left-right direction, for example. Hereinafter, on the display 108, the direction that is orthogonal to the first direction is referred to as a second direction. The second direction is the front-rear direction, for example. In the present embodiment, the discharge port 107 extends in the first direction.

For example, it is assumed that part of the print information is not printed on the printed heat sensitive tape 8. In this case, the user may instruct the printer 1 to perform the head check processing. There may be a case in which the user wants to check in advance the state of the heating elements corresponding to a section where important information (a barcode, for example) is to be printed. In this case, the user may specify, as the check range, a range that includes the heating elements corresponding to the section where the important information is to be printed.

Immediately after the head check processing is instructed, the entire head image 200 is a first image 201 that shows check elements. The check elements are heating elements in the check range. In the present embodiment, for example, the first image 201 may be displayed in yellow. Further, in the present embodiment, a message 221 is displayed on the display 108. The message 221 is a message that prompts the user to specify a starting point of the check range. For example, the message "Specify the starting point and press OK" is displayed as the message 221.

There is a case in which printing is performed by the printer 1 before the head check processing is instructed after a power source of the printer 1 is turned on. In this case, in the present embodiment, a print image 210 is further displayed on the display 108. The print image 210 shows at least part of the print information. For example, the print image 210 shows the characters "Number 0123456" and at least a part of a barcode. In the present embodiment, the print image 210 is displayed in pale gray. However, it is sufficient if the print image 210 is displayed in a form in which the user can visually check the print image 210. For example, the print image 210 may be displayed in monochrome. The print image 210 may be displayed in color.

In the present embodiment, the print image 210 is displayed on the display 108, in an area located in the second direction (the front-rear direction) with respect to the head image 200. The print image 210 is displayed at substantially the same scale as the head image 200. The print image 210 is displayed such that an image showing each of a plurality of dots that form at least part of the print information shown by the print image 210 and an image showing the heating element that prints each of the plurality of dots are arranged in the second direction.

Figure 7:
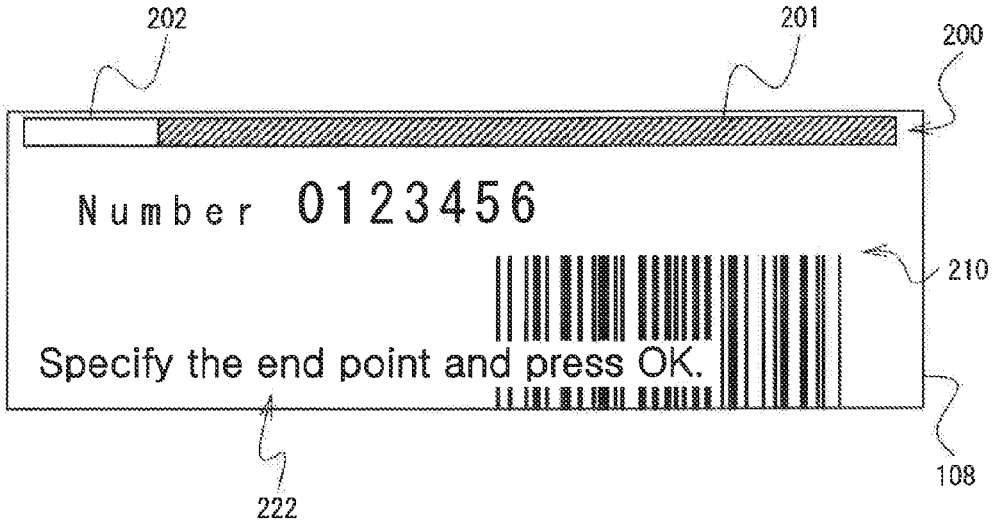
FIG. 7 is a diagram showing an image displayed on the display.

The user may use at least one of the right arrow key 33 and the left arrow key 32 to specify the starting point of the check range. Every time the user presses one of the right arrow key 33 and the left arrow key 32, a display form of the head image 200 is updated. More specifically, of the head image 200, the first image 201, which shows the check elements, and a second image 202, which shows non-check elements, are displayed in different forms. The non-check elements are heating elements outside the check range. For example, when the user continuously presses the right arrow key 33, a section on the left side of the head image 200 changes to the second image 202, as shown in FIG. 7. For example, the second image 202 may be displayed in blue.

When the user presses the OK key 34, the starting point of the check range is confirmed. In the present embodiment, a message 222 is displayed on the display 108, instead of the message 221. The message 222 is a message that prompts the user to specify an end point of the check range. For example, the message "Specify the end point and press OK" is displayed as the message 222.

Figure 8:
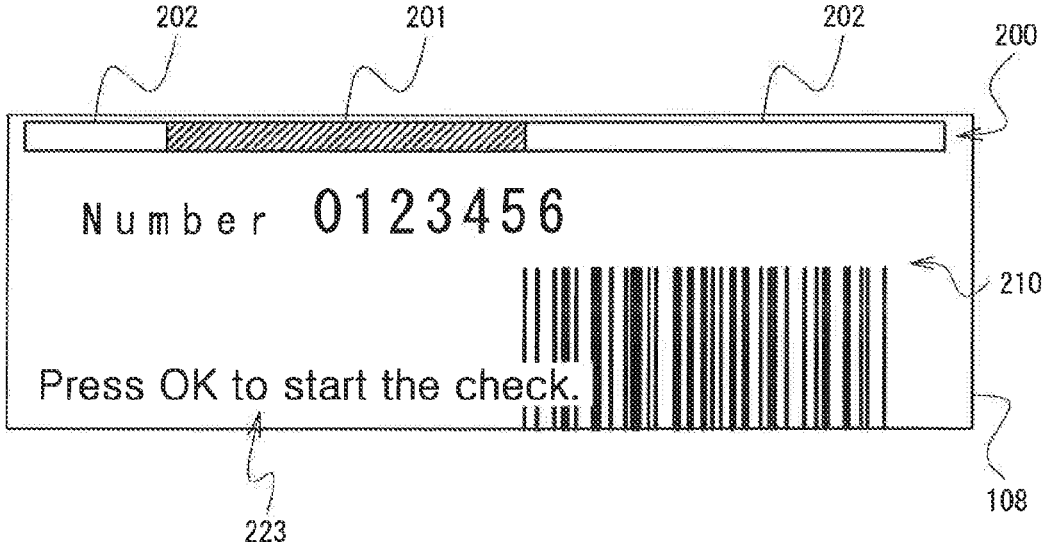
FIG. 8 is a diagram showing an image displayed on the display.

The user may use at least one of the right arrow key 33 and the left arrow key 32 to specify the end point of the check range. Every time the user presses one of the right arrow key 33 and the left arrow key 32, the display form of the head image 200 is updated. For example, when the user continuously presses the right arrow key 33, a section on the right side of the head image 200 is displayed in a different form from that of the check elements, as shown in FIG. 8. The section on the right side of the head image 200 changes to the second image 202.

When the user presses the OK key 34, the end point of the check range is confirmed. In the present embodiment, a message 223 is displayed on the display 108, instead of the message 222. The message 223 is a message that prompts the user to instruct the start of the check. For example, the message "Press OK to start the check" is displayed as the message 223.

When the user presses at least one of the right arrow key 33 and the left arrow key 32 and performs the same operation as described above, the user can specify the next check range. Meanwhile, when the user presses the OK key 34, the printer 1 starts to check the state of the heating elements in the check range. After the check, the printer 1 displays a check result on the display 108. In the present embodiment, the printer 1 updates the display form of the head image 200 based on the checked state of the heating elements. More specifically, within the head image 200, the printer 1 displays a third image 203 showing the heating element that is determined to be abnormal, in a different form from that of an image showing the heating elements that is determined to be normal.

Figure 9:
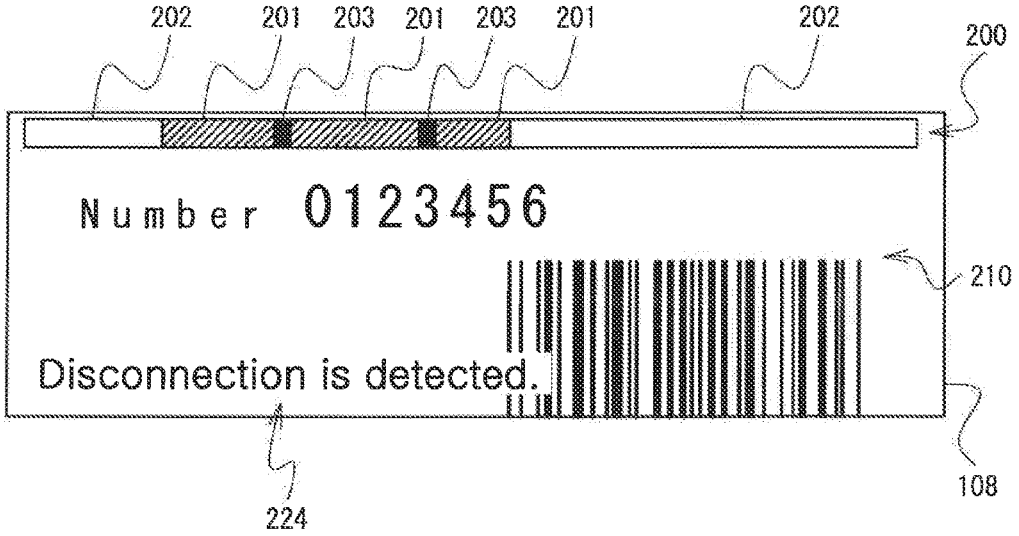
FIG. 9 is a diagram showing an image displayed on the display.

For example, it is assumed that some of the plurality of heating elements are determined to be abnormal. In this case, as shown in FIG. 9, each of the third images 203 is displayed in a different form from that of the image (the first image 201) showing the heating elements that are determined to be normal. In the present embodiment, for example, the third image 203 may be displayed in red.

Further, a message 224 is displayed on the display 108. The message 224 is a message that notifies the user that there is the heating element determined to be abnormal. For example, when a resistance value of the heating element is outside a specified range, it is determined that the heating element is abnormal. In the present embodiment, when disconnection of the heating element occurs, it is determined that the heating element is abnormal. In this case, the resistance value of the heating element becomes equal to or more than a specified value, or more specifically, becomes infinite. In this case, for example, the message "Disconnection is detected" is displayed as the message 224. By looking at the third image 203 of the head image 200, the user may confirm the presence of the heating element for which the disconnection has occurred. Further, by reading the message 224, the user may confirm the presence of the heating element for which the disconnection has occurred.

Figure 10:
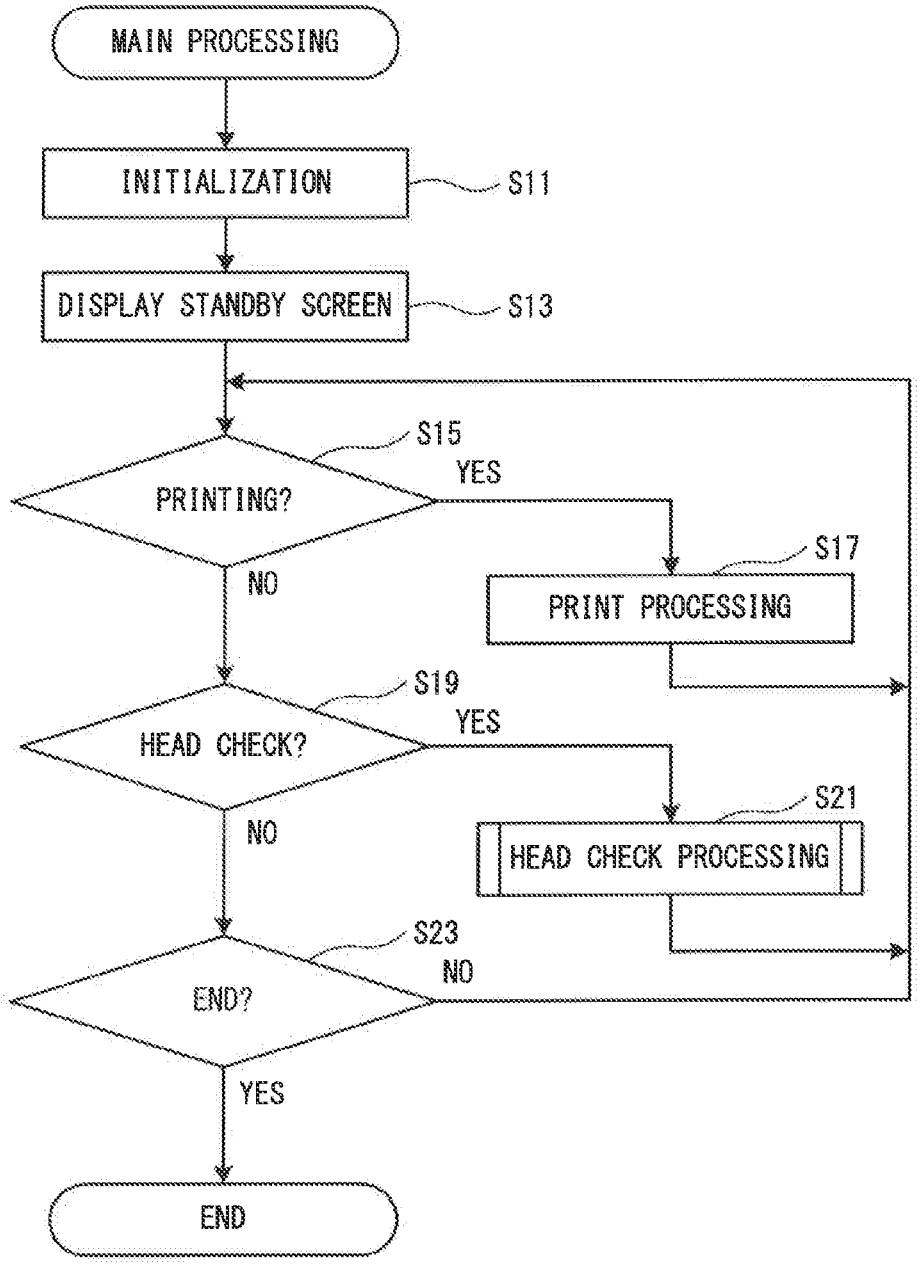
FIG. 10 is a flowchart of main processing.

Main processing of the printer 1 will be explained with reference to FIG. 10 to FIG. 18. When the power source of the printer 1 is turned on, the CPU 11 executes the program stored in the flash memory 13 and thus the main processing is started. As shown in FIG. 10, first, the CPU 11 performs initialization (step S11). At step S11, the data stored in the SRAM 12 is deleted. Next, the CPU 11 causes the display 108 to display a standby screen (not shown in the drawings) (step S13). The standby screen includes images that are respectively used to instruct the execution of the head check processing, the execution of the print processing, and the end of the main processing. The user may use at least one of the right arrow key 33 and the left arrow key 32 to select one of the images, and presses the OK key 34. In this manner, the user may instruct the printer 1 to perform one of the head check processing, the print processing, and the end of the main processing.

When the OK key 34 is pressed, the CPU 11 determines whether the image showing the print processing is selected (step S15). When the image showing the print processing is selected (yes at step S15), the CPU 11 performs the print processing (step S17). In the print processing, the CPU 11 controls the drive circuits 16 and 18 based on the print data received from the external terminal 2, thus printing the print information on the heat sensitive tape 8. When the image showing the print processing is not selected (no at step S15), the CPU 11 determines whether the image showing the head check processing is selected (step S19). When the image showing the head check processing is selected (yes at step S19), the CPU 11 performs the head check processing (refer to FIG. 11) (step S21).

The head check processing will be explained with reference to FIG. 11. First, the CPU 11 determines whether the print processing is performed at step S17 after the power source of the printer 1 is turned on (step S31). When the print processing is performed after the power source of the printer 1 is turned on (yes at step S31), the CPU 11 causes the display 108 to display the print image 210 (step S33). When the print processing is not performed after the power source of the printer 1 is turned on (no at step S31), or after performing the processing at step S33, the CPU 11 performs range specification processing (step S35).

The range specification processing will be explained with reference to FIG. 12 to FIG. 14. First, the CPU 11 sets a range specification number i to 0 (step S51). The range specification number i indicates the number of the specified check ranges. After that, the CPU 11 determines whether the range specification number i is larger than 0 (step S53). In the first cycle of processing, the range specification number i is 0 (no at step S53). Therefore, the CPU 11 sets a variable m to 0 (step S57). When the range specification number i is larger than 0 (yes at step S53), the CPU 11 sets the variable m to a value obtained by adding 1 to an end point [i−1] (step S55). The variable m is a variable that is used to determine a position at which the starting point of the check range can be specified. The end point [i−1] indicates the end point of the check range specified in processing in a previous cycle.

After the CPU 11 sets the variable m at one of step S55 and step S57, the CPU 11 sets a starting point [i] to the variable m and sets an end point [i] to an element number h (step S59). The element number h indicates the number of the heating elements of the line thermal head 112. For example, the line thermal head 112 may include 576 heating elements. In this case, the element number h is 576. The starting point [i] indicates the starting point of the current check range. The end point [i] indicates the end point of the current check range. In the first cycle of processing, the starting point [i] is 0 and the end point [i] is the element number h (576). Therefore, the starting point [i] indicates the heating element at the head end (the left end) in the main scanning direction. The end point [i] indicates the heating element at the tail end (the right end) in the main scanning direction.

After performing step S59, the CPU 11 causes the display 108 to display the message 221 (refer to FIG. 6) (step S61). As described above, the message 221 is the message that prompts the user to specify the starting point of the check range. After that, the CPU 11 performs head display processing (step S63).

Figure 15:
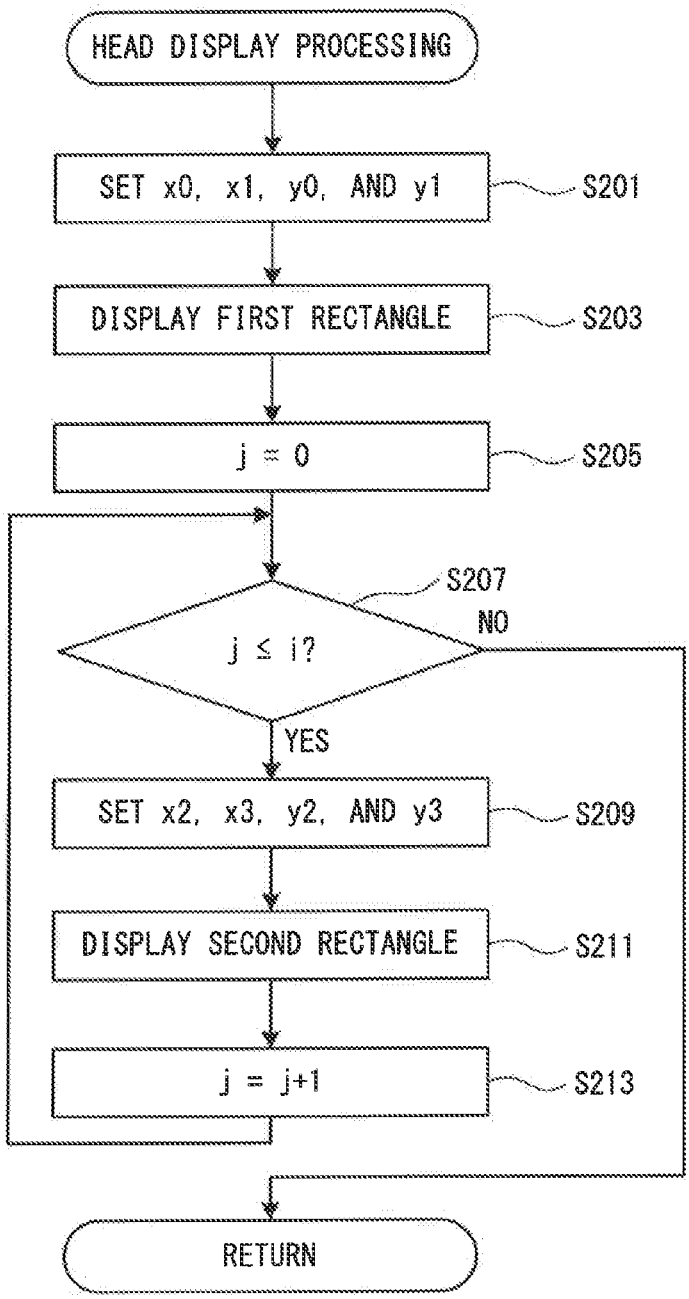
FIG. 15 is a flowchart of head display processing.

The head display processing will be explained with reference to FIG. 15. First, the CPU 11 sets values x0, x1, y0, and y1 that are used to indicate coordinates of vertices of a first rectangle (step S201). In the present embodiment, the setting value x0 is obtained as X0=(width pixel number w−(element number h/2))/2. The width pixel number w is the number of pixels in the first direction (the left-right direction) of the display area of the display 108. The width pixel number w may be 320, for example. Therefore, the setting value x0 may be 16, for example. The setting value x1 is obtained as x1=x0+(element number h/2). Therefore, the setting value x1 is 304, for example. The setting value y0 and the setting value y1 are smaller than a height pixel number. The height pixel number is the number of pixels in the second direction (the front-rear direction) of the display area of the display 108. Further, the setting value y1 is larger than the setting value y0. For example, the setting value y0 may be 16 and the setting value y1 may be 32.

After performing step S201, the CPU 11 causes the display 108 to display the first rectangle (S203). In the present embodiment, the coordinates of the pixel at the top left of the display area of the display 108 are defined as (0, 0). Then, one set of coordinates corresponds to one pixel in the display area of the display 108. In this case, the coordinates of the vertices of the first rectangle are (x0, y0), (x1, y0), (x0, y1), and (x1, y1). In the present embodiment, for example, the first rectangle may be displayed in blue.

After performing step S205, the CPU 11 sets a variable j to 0 (step S205). The variable j indicates the number of second rectangles that will be described below. The CPU 11 determines whether the variable j is equal to or less than the range specification number i (step S207). When the variable j is equal to or less than the range specification number i (yes at step S207), the CPU 11 sets values x2, x3, y2, and y3 that are used to indicate coordinates of vertices of the second rectangle (step S209). The setting value x2 is obtained as x2=x0+(starting point [i]/2). The setting value x3 is obtained as x3=x0+(end point [i]/2). The setting value y2 and the setting value y3 are each smaller than the height pixel number. Further, the setting value y3 is larger than the setting value y2. For example, the setting value y2 may be set to 16, which is the same value as the setting value y0. For example, the setting value y3 may be set to 32, which is the same value as the setting value y1.

After performing step S209, the CPU 11 causes the display 108 to display the second rectangle and updates the head image 200 (step S211). The coordinates of the vertices of the second rectangle are (x2, y2), (x3, y2), (x2, y3), and (x3, y3). The second rectangle is overwritten on the first rectangle displayed at step S203 and is displayed. The second rectangle is displayed in a different form from that of the first rectangle. In the present embodiment, the second rectangle is displayed in a different color (yellow, for example) from that of the first rectangle. The second rectangle indicates the heating elements in the specified check range of the head image 200. Therefore, the first image 201 shown in FIG. 7 and FIG. 8 is the second rectangle. On the other hand, a part of the first rectangle excluding the second rectangle indicates the heating element outside the check range of the head image 200. Therefore, the second image 202 shown in FIG. 7 and FIG. 8 is a part of the first rectangle excluding the second rectangle.

After performing step S211, the CPU 11 adds 1 to the variable j (step S213), and the processing returns to step S207. When the variable j is not equal to or less than the range specification number i (no at step S207), the CPU 11 ends the head display processing, and the processing returns to the range specification processing (refer to FIG. 12 to FIG. 14). After the head display processing at step S63 in the first cycle of processing, the entire head image 200 is the first image 201, which shows the check elements, as shown in FIG. 6. Together with the head image 200, the print image 210 displayed at step S33 and the message 221 displayed at step S61 are also displayed on the display 108. In the head display processing with respect to the second cycle of the range specification processing onward, the CPU 11 causes the display 108 to display the second rectangles, the number of which is (range specification number i+1). In this case, the displayed second rectangles include the second rectangle indicating the heating element in the check range specified by the previous range specification processing.

After performing the head display processing at step S63, the CPU 11 determines whether the left arrow key 32 is pressed (step S65). When the left arrow key 32 is pressed (yes at step S65), the CPU 11 determines whether or not the starting point [i] is larger than the variable m (step S67). When the starting point [i] is larger than the variable m (yes at step S67), the CPU 11 subtracts 1 from the starting point [i] (step S69). After that, the CPU 11 performs the head display processing (refer to FIG. 15) (step S77). In the present embodiment, when a plurality of the check ranges are specified, the CPU 11 receives the specification of the check range to the right of the already specified check range. Therefore, when the starting point [i] is not larger than the variable m (no at step S67), the CPU 11 does not subtract 1 from the starting point [i] and performs the head display processing (step S77).

When the left arrow key 32 is not pressed (no at step S65), the CPU 11 determines whether the right arrow key 33 is pressed (step S71). When the right arrow key 33 is pressed (yes at step S71), the CPU 11 determines whether or not the starting point [i] is smaller than a value (h−1) obtained by subtracting 1 from the element number h (step S73). When the starting point [i] is smaller than the value (h−1) (yes at step S73), the CPU 11 adds 1 to the starting point [i] (step S75). After that, the CPU 11 performs the head display processing (refer to FIG. 15) (step S77). After the head display processing at step S77, a part of the left side of the head image 200 changes to the second image 202, as shown in FIG. 7, for example. The left end of the first image 201 indicates the starting point of the check range.

In the present embodiment, the CPU 11 receives the specification of the end point to the right of the starting point of the check range. Therefore, when the starting point [i] is not smaller than the value (h−1) (no at step S73), the end point cannot be specified to the right of the starting point [i]. In this case, the CPU 11 does not add 1 to the starting point [i] and performs the head display processing (step S77).

When the right arrow key 33 is not pressed (no at step S71), the CPU 11 determines whether the OK key 34 is pressed (step S79). When the OK key 34 is pressed (yes at step S79), the CPU 11 sets the end point [i] to a value obtained by adding 1 to the starting point [i] (step S81). When the OK key 34 is not pressed (no at step S79), the processing returns to step S65.

After performing step S81, the CPU 11 causes the display 108 to display the message 222 (refer to FIG. 7) (step S83). As described above, the message 222 is the message that prompts the user to specify the end point of the check range. As shown in FIG. 7, together with the message 222, the head image 200 displayed at one of step S63 and step S77 and the print image 210 displayed at step S33 are also displayed on the display 108. After performing step S83, the CPU 11 determines whether the left arrow key 32 is pressed (step S85).

When the left arrow key 32 is pressed (yes at step S85), the CPU 11 determines whether the end point [i] is larger than the starting point [i] (step S87). When the end point [i] is larger than the starting point [i] (yes at step S87), the CPU 11 subtracts 1 from the end point [i] (step S89). After that, the CPU 11 performs the head display processing (refer to FIG. 15) (step S97). When the end point [i] is not larger than the starting point [i] (no at step S87), the CPU 11 does not subtract 1 from the end point [i] and performs the head display processing (step S97).

When the left arrow key 32 is not pressed (no at step S85), the CPU 11 determines whether the right arrow key 33 is pressed (step S91). When the right arrow key 33 is pressed (yes at step S91), the CPU 11 determines whether the end point [i] is smaller than the element number h (step S93). When the end point [i] is smaller than the element number h (yes at step S93), the CPU 11 adds 1 to the end point [i] (step S95). After that, the CPU 11 performs the head display processing (refer to FIG. 15) (step S97). After the head display processing at step S97, a part of the right side of the head image 200 changes to the second image 202, as shown in FIG. 8, for example. The right end of the first image 201 indicates the end point of the check range.

When the end point [i] is not smaller than the element number h (no at step S93), the end point [i] indicates the heating element at the right end. Therefore, the CPU 11 does not add 1 to the end point [i] and performs the head display processing (step S97).

When the right arrow key 33 has not been pressed (no at step S91), the CPU 11 determines whether or not the OK key 34 has been pressed (step S99). When the OK key 34 has not been pressed (no at step S99), the CPU 11 determines whether or not the BACK key 31 has been pressed (step S103). When the BACK key 31 has been pressed (yes at step S103), the CPU 11 sets the end point [i] to the element number h (step S105), and the processing returns to step S61. Therefore, the user can once again specify the starting point of the check range. When the BACK key 31 has not been pressed (no at step S103), the processing returns to step S85.

When the OK key 34 has been pressed (yes at step S99), the CPU 11 determines whether or not the end point [i] is smaller than the element number h (step S107). When the end point [i] is not smaller than the element number h (no at step S107), the end point [i] indicates the heating element at the right end. In other words, the check range cannot be specified to the right of the already specified check range. Accordingly, there is no need to specify the next check range. In this case, the CPU 11 adds 1 to the range specification number i (step S121), and ends the range specification processing. After that, the CPU 11 returns to the head check processing (refer to FIG. 11).

On the other hand, when the end point [i] is smaller than the element number h (yes at step S107), the CPU 11 causes the display 108 to display the message 223 (refer to FIG. 8) (step S109). As described above, the message 223 is the message that prompts the user to instruct the start of the check. After performing the processing at step S109, the CPU 11 determines whether one of the left arrow key 32 and the right arrow key 33 is pressed (step S111).

When one of the left arrow key 32 and the right arrow key 33 is pressed (yes at step S111), the CPU 11 determines whether the range specification number i is equal to or more than a value (n−1) obtained by subtracting 1 from an allowable specification number n (step S113). The allowable specification number n is the number of the check ranges that can be specified (for example, 5). When the range specification number i is equal to or more than the value (n−1) (yes at step S113), the CPU 11 adds 1 to the range specification number i (step S121). After that, the CPU 11 ends the range specification processing and returns to the head check processing (refer to FIG. 11). When the range specification number i is not equal to or more than the value (n−1) (no at step S113), the CPU 11 adds 1 to the range specification number i (step S115), and the processing returns to step S53.

When one of the left arrow key 32 and the right arrow key 33 is not pressed (no at step S111), the CPU 11 determines whether the OK key 34 is pressed (step S117). When the OK key 34 is not pressed (no at step S117), the CPU 11 determines whether the BACK key 31 is pressed (step S119). When the BACK key 31 is not pressed (no at step S119), the processing returns to step S111. On the other hand, when the BACK key 31 is pressed (yes at step S119), the processing returns to step S83. Therefore, the user may once again specify the end point of the check range.

When the OK key 34 is pressed (yes at step S117), the CPU 11 adds 1 to the range specification number i (step S121). After that, the CPU 11 ends the range specification processing and returns to the head check processing (refer to FIG. 11). When the CPU 11 returns to the head check processing, the CPU 11 performs error check processing (step S37).

Figure 16:
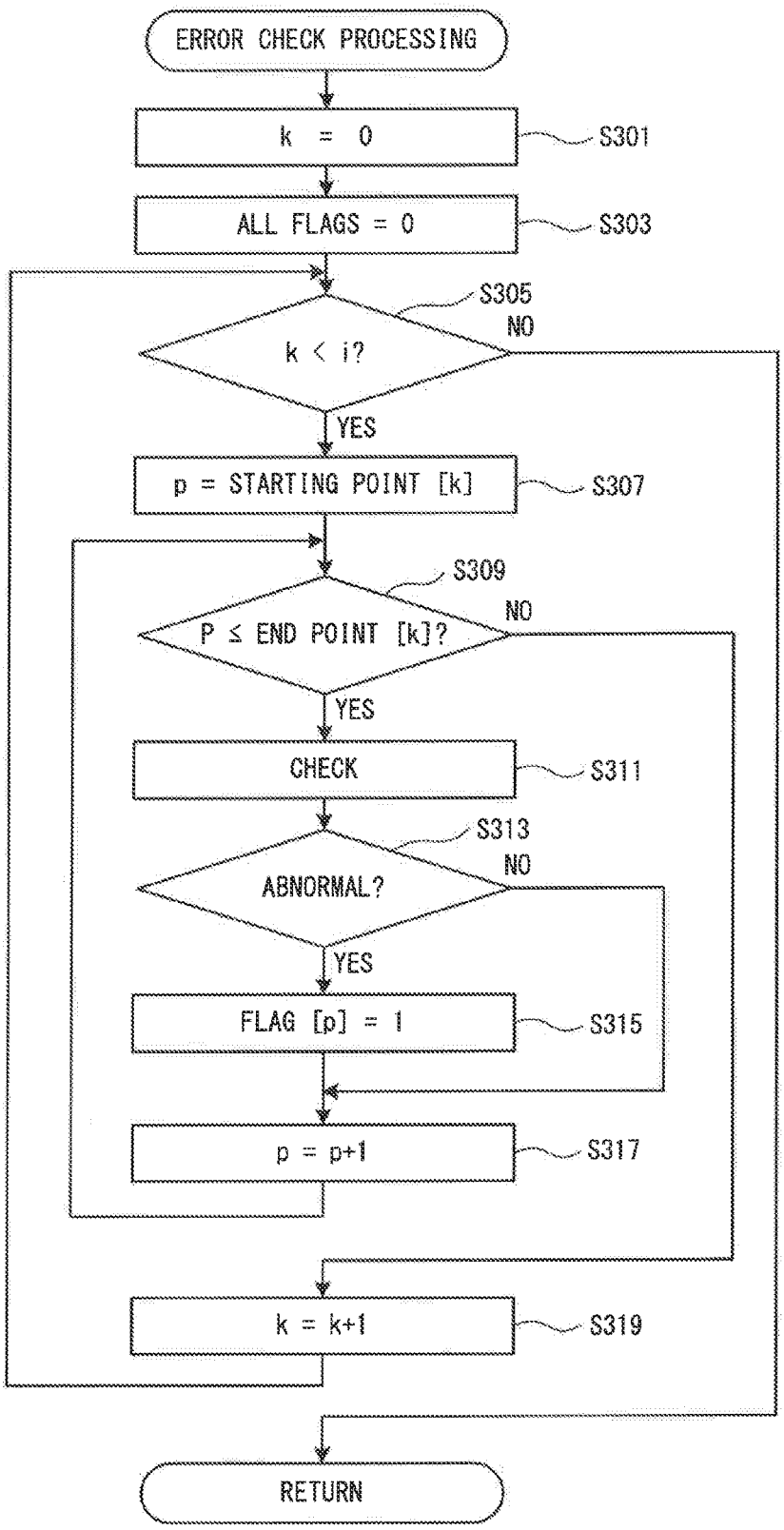
FIG. 16 is a flowchart of error check processing.

The error check processing will be explained with reference to FIG. 16. First, the CPU 11 sets a variable k to 0 (step S301). The CPU 11 sets a flag to 0 for each of the heating elements of the line thermal head 112 (step S303). The flag "0" indicates that the heating element is normal. The flag "1" indicates that the heating element is abnormal.

After performing the processing at step S303, the CPU 11 determines whether the variable k is smaller than the range specification number i (step S305). When the variable k is smaller than the range specification number i (yes at step S305), the check of the state of the heating elements is not completed for the check ranges corresponding to the range specification number i. In this case, the CPU 11 sets a starting point [k] to a variable p (step S307).

The variable p indicates an order of the heating elements in the main scanning direction. In the present embodiment, the order of the heating element at the head end (the left end) in the main scanning direction is defined as 0. The order of the heating elements is set in an ascending order from the head end to the tail end (from the left to the right). For example, as described above, when the line thermal head 112 includes the 576 heating elements, the order of the heating element at the tail end (the right end) is 575. The starting point [k] indicates the starting point of the check range that is set as the current processing target. When k is 0, the starting point [k] indicates the order of the heating element that is the starting point of the first check range.

The CPU 11 determines whether the variable p is equal to or less than an end point [k] (step S309). The end point [k] indicates the end point of the check range set as the current processing target. When k is 0, the end point [k] indicates the order of the heating element that is the end point of the first check range. When the variable p is equal to or less than the end point [k] (yes at step S309), the check is not completed for all the heating elements in the current check range. In this case, the CPU 11 checks the state of a p-th heating element in the main scanning direction (step S311). In the present embodiment, the CPU 11 checks whether a disconnection occurs in the p-th element from the left. The CPU 11 controls the drive circuit 16 to energize the p-th heating element and measures a voltage value and an electric current value using a known voltage measurement circuit and a known electric current measurement circuit. The CPU 11 obtains a resistance value based on the measured voltage value and the measured electric current value. Based on the obtained resistance value, the CPU 11 checks whether a disconnection occurs in the heating element.

Based on a check result at step S311, the CPU 11 determines whether the heating element is abnormal (step S313). When the heating element is abnormal (yes at step S313), the CPU 11 sets a flag [p] to 1 (step S315). The flag [p] is a flag of the p-th heating element in the main scanning direction. When the heating element is not abnormal (no at step S313) or after performing the processing at step S315, the CPU 11 adds 1 to the variable p (step S317). After performing the processing at step S317, the processing returns to step S309 and the above-described processing is repeated for the heating elements in the current check range (step S309 to step S317).

When the variable p is not equal to or less than the end point [k] (no at step S309), the check is completed for all the heating elements in the current check range. Therefore, the CPU 11 adds 1 to the variable k (step S319), and the processing returns to step S305. The CPU 11 checks the state of the heating elements in the next check range. When the check of the state of the heating elements is completed for all the check ranges corresponding to the range specification number i, the variable k is not smaller than the range specification number i (no at step S305). In this case, the CPU 11 ends the error check processing and returns to the head check processing (refer to FIG. 11). When the CPU 11 returns to the head check processing, the CPU 11 performs result display processing (step S39).

The result display processing will be explained with reference to FIG. 17. First, the CPU 11 performs the head display processing (refer to FIG. 15) (step S401). Based on the check range specified by the range specification processing (refer to FIG. 12 to FIG. 14), the head image 200 that includes the first image 201 and the second image 202 is displayed on the display 108. After performing the processing at step S401, the CPU 11 sets the variable p to 0 and sets an NG flag number f to 0 (step S403). The NG flag number f is the number of the heating elements for which the flag is 1. After performing the processing at step S403, the CPU 11 determines whether the variable p is smaller than the element number h (step S405).

When the variable p is smaller than the element number h (yes at step S405), the CPU 11 determines whether the flag [p] is 1 (step S407). When the flag [p] is 1 (yes at step S407), the p-th heating element in the main scanning direction is abnormal. In this case, the CPU 11 performs NG display processing (step S409).

Figure 18:
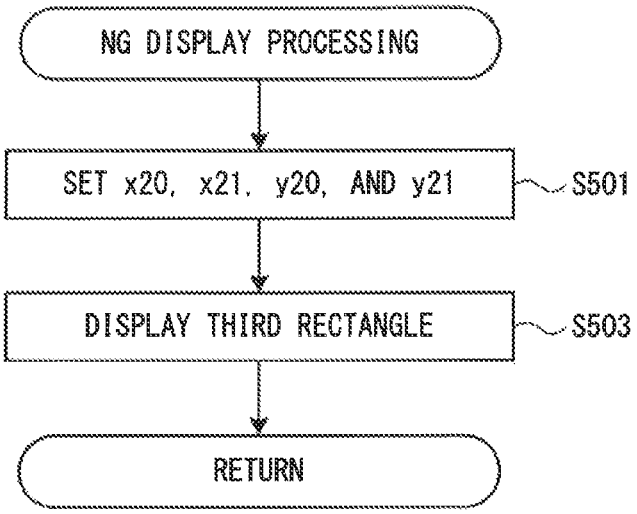
FIG. 18 is a flowchart of NG display processing.

The NG display processing will be explained with reference to FIG. 18. First, the CPU 11 sets values x20, x21, y20, and y21 that are used to specify coordinates included in a third rectangle (step S501). In the present embodiment, the setting value x20 is obtained as x20=(width pixel number w—(element number h/2))/2. The setting value x21 is obtained as x21=x20+(p/2). The setting value y20 and the setting value y21 are each smaller than the height pixel number. Further, the setting value y21 is larger than the setting value y20. For example, the setting value y20 may be set to 16, which is the same value as the setting value y0. For example, the setting value y21 may be set to 32, which is the same value as the setting value y1.

After performing the processing at step S501, the CPU 11 causes the display 108 to display the third rectangle (step S503). The third rectangle includes pixels in a range in which the x coordinate is x21 and the y coordinate is y20 to y21. The third rectangle is overwritten on the head image 200 displayed at step S401 and is displayed. In the present embodiment, the third rectangle is displayed in a different form from that of the second rectangle. Further, the third rectangle is displayed in a form that is different from that of the first rectangle. In the present embodiment, the third rectangle is displayed in a color different from that of the second rectangle. Further, the third rectangle is displayed in a color that is different from that of the first rectangle. For example, the third rectangle may be displayed in red.

Figure 17:
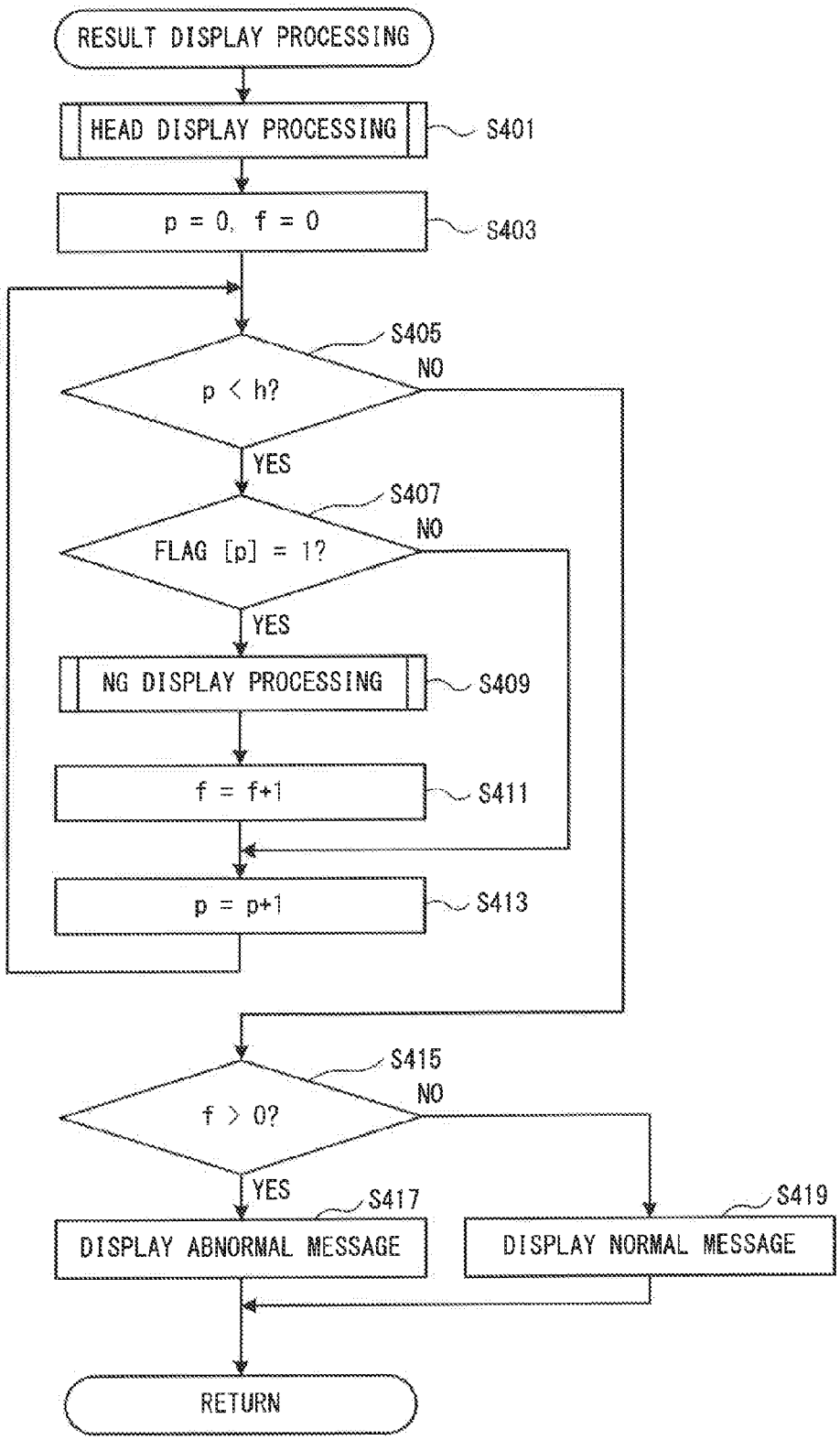
FIG. 17 is a flowchart of result display processing.

After performing the processing at step S503, the CPU 11 ends the NG display processing and returns to the result display processing (refer to FIG. 17). When the CPU 11 returns to the result display processing, the CPU 11 adds 1 to the NG flag number f (step S411).

When the flag [p] is not 1 (no at step S407) or after performing the processing at step S411, the CPU 11 adds 1 to the variable p (step S413), and the processing returns to step S405. When the variable p is not smaller than the element number h (no at step S405), the processing is completed for all the heating elements. In this case, the CPU 11 determines whether the NG flag number f is larger than 0 (step S415).

When the NG flag number f is larger than 0 (yes at step S415), there is an abnormal heating element. In this case, the CPU 11 causes the display 108 to display the message 224 (step S417). As described above, in the present embodiment, the message 224 is the abnormal message that notifies the user that there is a heating element determined to be abnormal. For example, as shown in FIG. 9, the message "Disconnection is detected" is displayed as the message 224. Together with the message 224, the head image 200 displayed at step S401 and step S409 and the print image 210 displayed at step S33 are displayed on the display 108.

When the NG flag number f is not larger than 0 (no at step S415), there is no abnormal heating element. In this case, the CPU 11 causes the display 108 to displays the normal message that notifies the user that all the heating elements are normal (step S419). For example, the normal message "Heating elements are normal" may be displayed.

Figure 11:
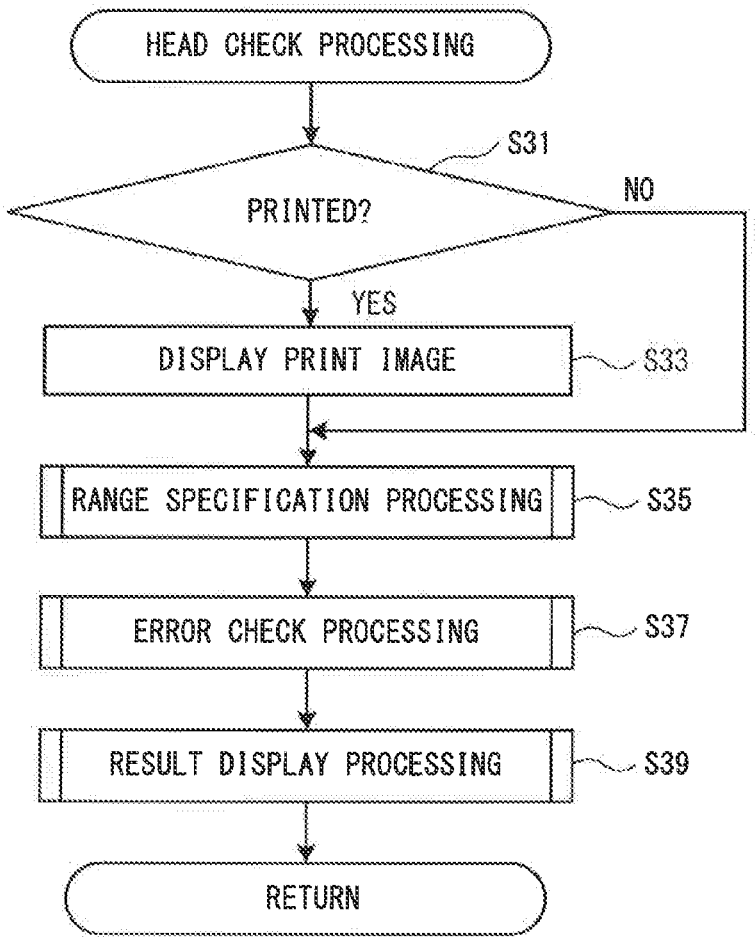
FIG. 11 is a flowchart of head check processing.

After performing the processing at one of step S147 and step S419, the CPU 11 ends the result display processing and returns to the head check processing (refer to FIG. 11). After that, the CPU 11 ends the head check processing and returns to the main processing (refer to FIG. 10), and then the processing returns to step S15.

When neither the image showing the print processing nor the image showing the head check processing is selected (no at step S15 and no at step S19), the CPU 11 determines whether the image showing the end of the main processing is selected (step S23). When the image showing the end of the main processing is not selected (no at step S23), the processing returns to step S15. When the image showing the end of the main processing is selected (yes at step S23), the CPU 11 ends the main processing.

For example, when part of the print information is not printed on the printed heat sensitive tape 8, the user may instruct the printer 1 to perform the head check processing. In the head check processing, it is assumed that it is determined that there is no abnormal heating element. In this case, the user may confirm that there is no abnormal heating element by looking at the head image 200 displayed on the display 108 or by looking at the normal message. Further, in this case, there is a possibility that dust or dirt is attached to the line thermal head 112. Therefore, there is a possibility that the user can eliminate the printing failure by cleaning the line thermal head 112. On the other hand, when it is determined by the head check processing that there is an abnormal heating element, the user may have the printer 1 repaired and have the line thermal head 112 replaced.

As explained above, according to the printer 1 of the present embodiment, when the execution of the head check processing is instructed, the head image 200 is displayed on the display 108. The printer 1 is configured to receive, via the operation portion 30, the specification of the check range that includes the heating elements to be checked among the plurality of heating elements. When the printer 1 receives the specification of the check range, the printer 1 checks the state of the heating elements included in the check range. After that, the printer 1 displays the check result on the display 108. Thus, the user may input the specification of the check range to the printer 1. The printer 1 can check the state of the heating elements included in the range desired by the user. Further, by looking at the check result displayed on the display 108, the user may know the state of the checked heating elements.

After the error check processing, the head image 200 displayed on the display 108 is updated. Therefore, by looking at the head image 200 displayed on the display 108, the user may confirm the check result of the state of the heating elements. More specifically, when the head image 200 is updated, the third image 203 that shows the heating element determined to be abnormal is displayed in a different form from that of the image that shows the heating elements determined to be normal. By looking at the head image 200, the user may easily know the heating element determined to be abnormal among the plurality of heating elements.

Further, the print image 210 that shows at least part of the print information is displayed on the display 108. The print image 210 is displayed on the display 108, in an area located in the second direction with respect to the head image 200. The second direction is a direction that is orthogonal to the first direction in which the plurality of heating elements shown by the head image 200 are arrayed. Further, the print image 210 is displayed at substantially the same scale as the head image 200. Further, the print image 210 is displayed such that an image showing each of a plurality of dots that form at least part of the print information shown by the print image 210 and an image showing the heating element that prints each of the plurality of dots are arranged in the second direction.

Therefore, by confirming the head image 200 and the print image 210 that are displayed on the display 108, the user may easily know which section of the print information corresponds to which of the plurality of heating elements. Further, there is a case in which the print information in a section that corresponds to an abnormal heating element is not important information such as a barcode. In this case, the user may continue to use the line thermal head 112 without replacing the line thermal head 112.

Of the head image 200, the second rectangle (refer to the first image 201 shown in FIG. 7 and FIG. 8) and the section (refer to the second image 202 shown in FIG. 7 and FIG. 8)

of the first rectangle excluding the second rectangle are displayed in different forms on the display 108. The second rectangle indicates the heating elements in the check range. The section of the first rectangle excluding the second rectangle indicates the heating elements outside the check range. Therefore, the user may easily ascertain the check range by confirming the head image 200 displayed on the display 108.

Various modifications are possible to the above-described embodiment. For example, regardless of whether or not the print information is printed, when the print data is stored in the SRAM 12, the print image 210 may be displayed on the display 108. For example, the user may confirm the print image 210 displayed on the display 108 before the printing. The user may specify, as the check range, only a range that includes the heating elements corresponding to an important information section of at least part of the print information shown by the print image 210.

The printer 1 may acquire the print data using a method other than the method of receiving the print data from the external terminal 2 via the USB cable 3. For example, the printer 1 may receive the print data from the external terminal 2 by wireless communication. The printer 1 may include a medium reading device. In this case, the printer 1 may acquire the print data stored in a storage medium (such as a memory card) via the medium reading device. For example, the print image 210 need not necessarily be displayed.

The display 108 may have a display area that is equal to or longer than the length, in the main scanning direction, of the plurality of heating elements of the line thermal head 112. The head image 200 may be displayed in a form in which the length in the first direction of the plurality of heating elements shown by the head image 200 substantially corresponds to the actual length in the main scanning direction of the plurality of heating elements. In this case, even when the print image 210 is not displayed on the display 108, the user may compare the printed heat sensitive tape 8 and the head image 200 displayed on the display 108. Thus, the user may easily know which section of the heat sensitive tape 8 corresponds to which of the plurality of heating elements.

Further, when the heat sensitive tape 8 is discharged from the discharge port 107, the head image 200 may be displayed on the display 108 such that each of the plurality of dots forming the print information printed on the heat sensitive tape 8 and the image showing the heating element that has printed each of the plurality of dots are arranged in the second direction. In the above-described embodiment, the discharge port 107 extends in the first direction and is close to the display 108. Specifically, the discharge port 107 is provided between the fixed portion 101A and the opening/closing lid 101B, and the display 108 is provided on the fixed portion. More specifically, the operation portion 30 is provided on the fixed portion 101A, and the display 108 is provided between the operation portion 30 and the discharge port 107. Therefore, in this case, the user may easily compare the print information printed on the heat sensitive tape 8 and the head image 200 displayed on the display 108. Thus, the user may easily know which section of the heat sensitive tape 8 corresponds to which of the plurality of heating elements.

The discharge port 107 may extend in a direction other than the first direction. The discharge port 107 need not necessarily be close to the display 108.

The print image 210 may be displayed such that an image showing each of a plurality of dots that form at least part of the print information shown by the print image 210 and an image showing the heating element that prints each of the plurality of dots are arranged in a direction other than the second direction. The print image 210 may be displayed on the display 108, in an area other than the area that is located in the second direction with respect to the head image 200. For example, the head image 200 and the print image 210 may be displayed such that the head image 200 and the print image 210 are arranged in the first direction. The print image 210 may be displayed in a scale different from that of the head image 200.

Figure 12:
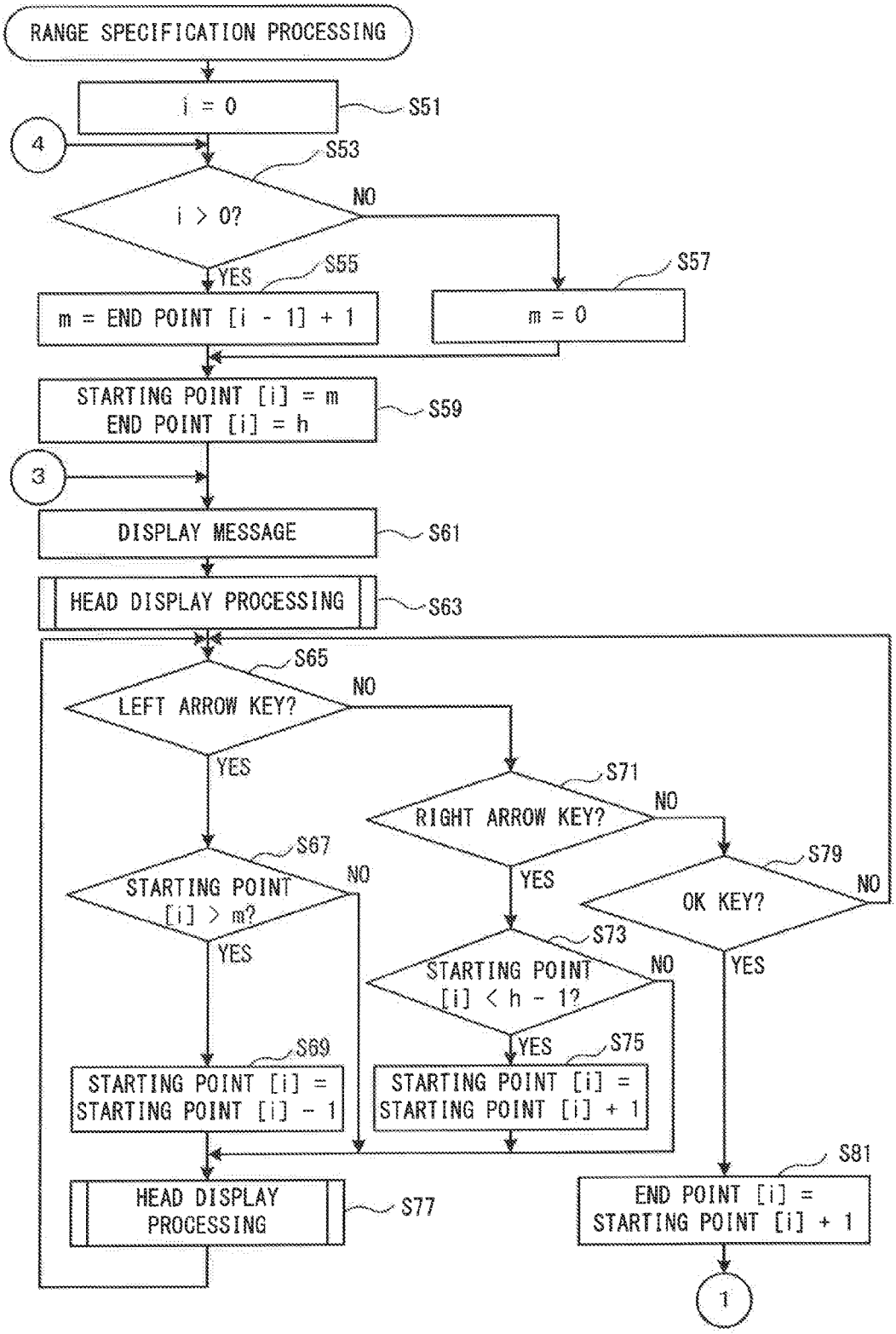
FIG. 12 is a flowchart of range specification processing.
Figure 13:
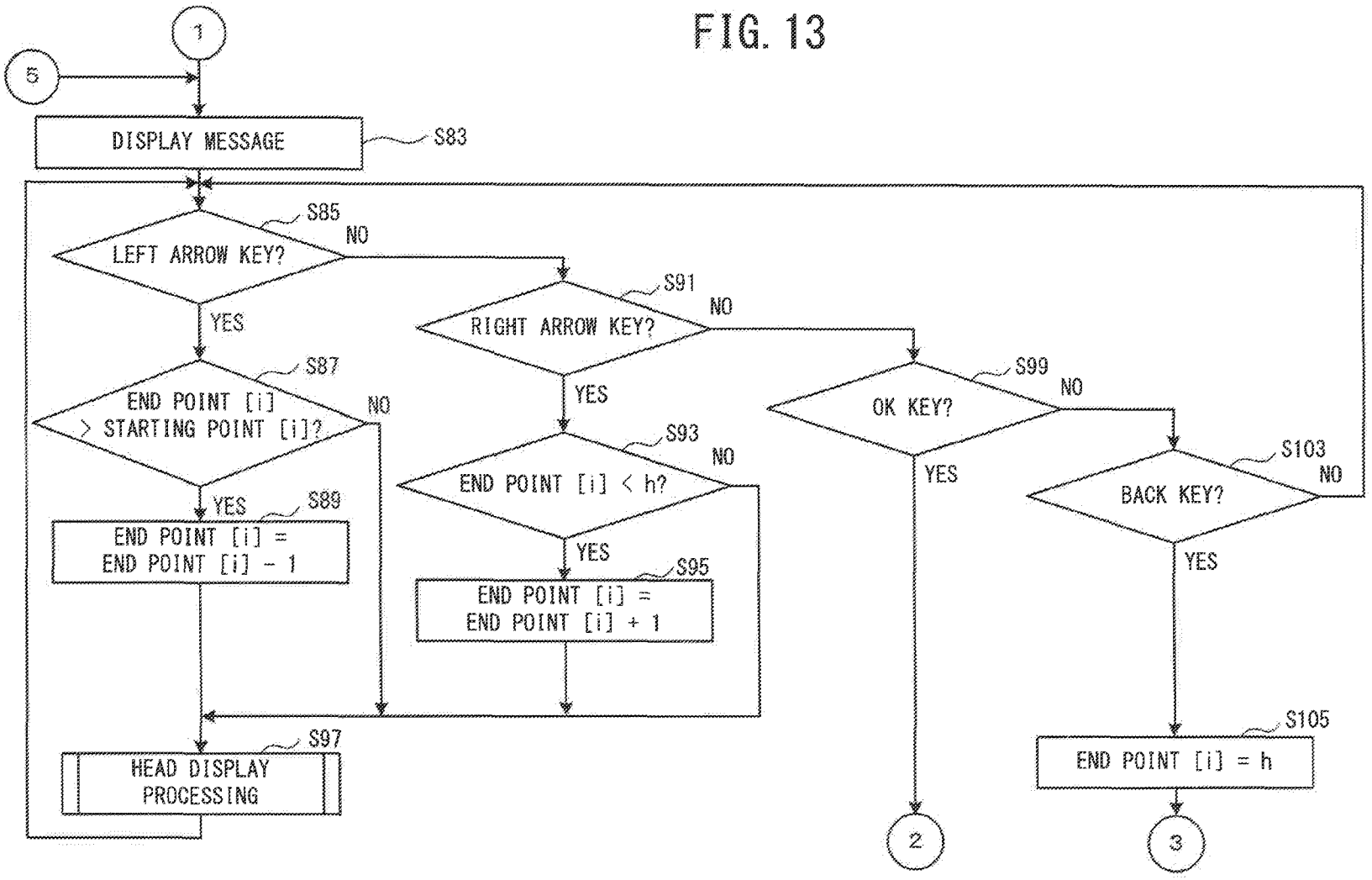
FIG. 13 is a flowchart of the range specification processing, and is a continuation of FIG. 12.
Figure 14:
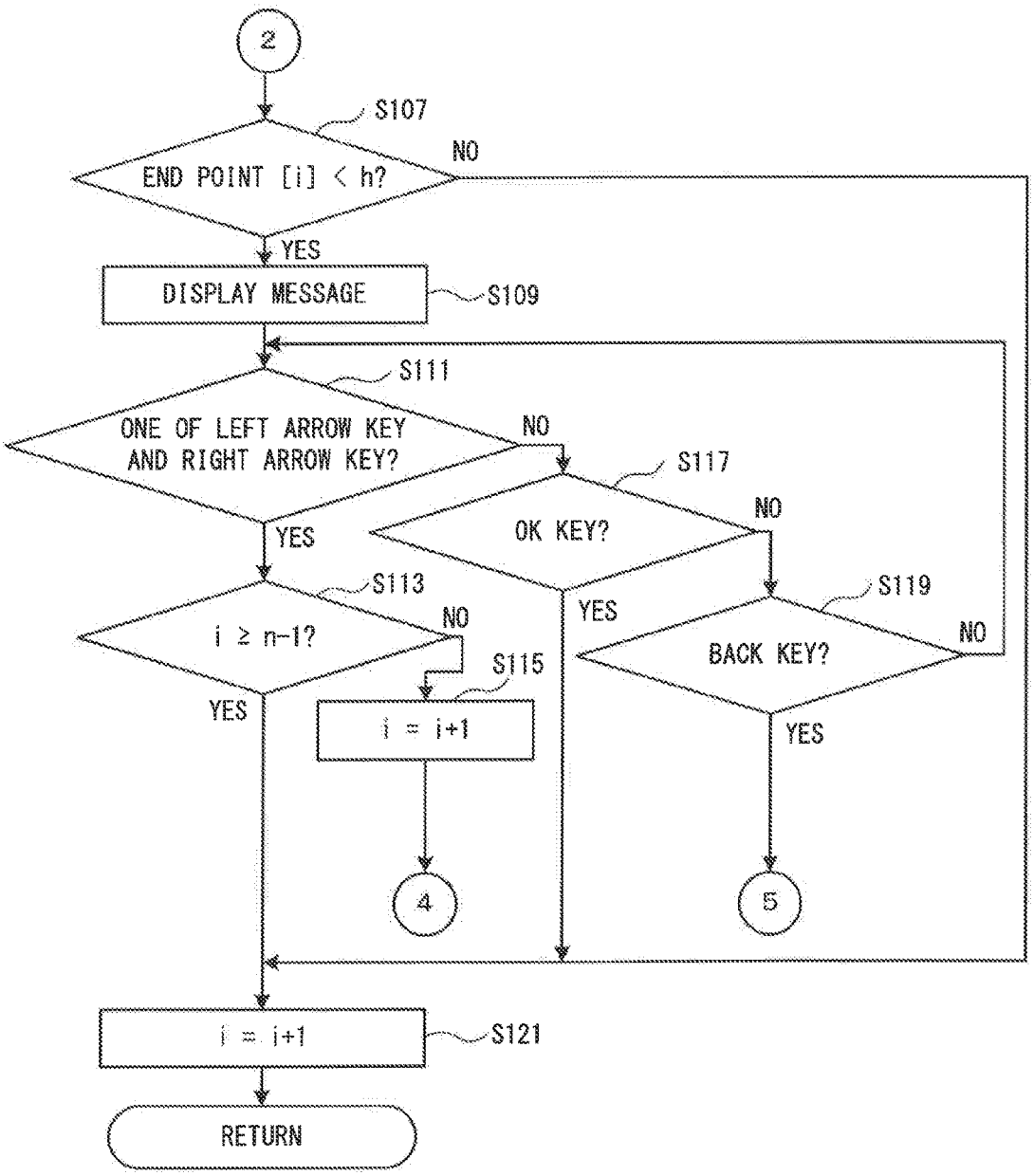
FIG. 14 is a flowchart of the range specification processing, and is a continuation of FIG. 13.

In the above-described embodiment, the CPU 11 can receive the specification of a plurality of the check ranges in the range specification processing (refer to FIG. 12 to FIG. 14). However, the CPU 11 may be able to receive the specification of only one check range. When a plurality of the check ranges are specified in the range specification processing, the CPU 11 may be able to receive the specification of the check range located to the left of the already specified check range. The CPU 11 may be able to receive a plurality of the check ranges that at least partly overlap with each other.

In the above-described embodiment, after the error check processing, the first image 201, the second image 202, and the third image 203 in the head image 200 are respectively displayed in different display forms, as shown in FIG. 9. The first image 201 shows the heating elements determined not to be abnormal among the heating elements included in the check range. The second image 202 shows the non-check elements, which are not to be checked. The third image 203 shows the heating elements determined to be abnormal among the heating elements included in the check range. However, the first image 201 and the second image 202 may be displayed in the same display form. The third image 203 only may be displayed in a display form that is different from that of the images showing the other heating elements. After the head check, one of the head image 200 and the message (one of the abnormal message and the normal message) need not necessarily be displayed. The user may know the state of the checked heating elements by looking at one of the head image 200 and the message.

In the above-described embodiment, the printer 1 performs the result display processing (refer to FIG. 17) for all the heating elements of the line thermal head 112. However, the processing at step S403 to step S413 may be performed only for the heating elements checked by the error check processing (refer to FIG. 16). In this case, the printer 1 can shorten the processing time.

The printer 1 may include a touch panel on the display 108. The operation portion 30 may be displayed on the display 108. In this case, the user may touch a position of the touch panel corresponding to a position of the operation portion 30 displayed on the display 108, using the user's finger or a touch pen. In this manner, the user may input an instruction to the printer 1.

The main processing may be performed by an electronic component (such as an application specific integrated circuit) other than the CPU 11. The main processing may be distributed and processed by a plurality of electronic devices (namely, a plurality of CPUs).

In the above-described embodiment, the printer 1 that is configured to perform printing on the heat sensitive tape 8 is exemplified. However, it is sufficient if a printer that includes at least a line thermal head and a display is used. For example, a printer that is configured to print an image, a character, etc. on heat sensitive paper may be used.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a printing portion that includes a plurality of heating elements arrayed in a main scanning direction, the printing portion being configured to perform printing on a print medium;

a display configured to display an image; and a processor configured to:

cause the display to display a first image in a first color, the first image being an image that shows all the plurality of the heating elements;

receive specification of a check range in a state where the first image is displayed on the display, the check range being a range that includes a heating element to be checked among the plurality of the heating elements;

check, in a case where the specification of the check range is received, a state of the heating element included in the check range; and cause the display to display a check result of the state of the heating element, wherein checking the state of the heating element includes determining whether the heating element is abnormal by determining if a parameter is outside a specified range, the heating element being abnormal when the parameter is outside the specific range, and wherein the causing the display to display the check result includes causing the display to display the check result by updating, based on the checked state of the heating element, a display form of all the plurality of heating elements of the first image displayed on the display, and causing the display to display a first element image in a second color and a second element image in a third color, the first image including the first element image and the second element image, the first element image being an image that shows the heating element determined to be abnormal, the second element image being an image that shows the heating element determined to be normal and the second color being different from the third color.

2. The printer according to claim 1, wherein the processor is further configured to cause the display to display a second image, the second image being an image that shows at least part of a printed image, the printed image being, when all the plurality of the heating elements are normal, an image printed on the printing medium by the printing portion or an image to be printed on the print medium by the printing portion, the first image is displayed, on the display, in a form in which images showing the plurality of the heating elements are arrayed in a first display direction, the first display direction being the same direction as the main scanning direction, the second image is displayed, on the display, in an area located in a second display direction with respect to the first image, the second display direction being a direction orthogonal to the first display direction, and the causing the display to display the second image includes:

causing the display to display the second image at substantially the same scale as the first image, and causing the display to display the second image by arranging, in a second direction on the display, an image of the second image, that shows each of a plurality of dots forming at least part of the printed image and an image of the first image, that shows the heating element configured to print each of the plurality of dots.

3. The printer according to claim 1, wherein the first image is displayed, on the display, in a form in which images showing the plurality of the heating elements are arrayed in a first display direction, the first display direction being the same direction as the main scanning direction, the display includes a display area that is equal to or longer than a length, in the main scanning direction of the plurality of the heating elements, and the causing the display to display the first image includes causing the display to display the first image in a form in which a length of the first image in the first display direction of the plurality of the heating elements shown by the first image substantially matches an actual length in the main scanning direction of the plurality of the heating elements.

4. The printer according to claim 3, further comprising:

a platen roller configured to feed the print medium in a direction orthogonal to the main scanning direction; and a discharge port configured to discharge the print medium printed by the printing portion and fed by the platen roller, wherein the discharge port is close to the display and extends in the main scanning direction, and wherein the causing the display to display the first image includes causing the display to display the first image in a form in which each of a plurality of dots that form the printed image printed on the print medium discharged from the discharge port and the image that shows the heating element that has printed each of the plurality of dots are arranged in a second display direction, the second display direction being a direction orthogonal to the first display direction.

5. The printer according to claim 4, further comprising:

a housing having a substantially box shape, the housing accommodating the printing portion and the platen roller, wherein the housing includes a top cover and an undercover, wherein the top cover is provided on an upper surface of the housing, wherein the undercover is provided on a lower surface of the housing, wherein the top cover includes a fixed portion and an opening/closing portion, wherein the fixed portion is a front section of the top cover, wherein the opening/closing portion is a rear section of the top cover, wherein the opening/closing portion is configured to be opened and closed with respect to the fixed portion, wherein the display is provided on the fixed portion, wherein the discharge port is provided in a substantially central portion in a front-rear direction of the top cover, between the fixed portion and the opening/closing portion, and wherein the discharge port is provided to a rear of the display and in a vicinity of the display.

6. The printer according to claim 5, further comprising:

an operation portion configured to input the specification of the check range to the printer, the operation portion being provided on a front section of an upper surface of the fixed portion, wherein the display is provided between the operation portion and the discharge port, and wherein the operation portion is provided to a front of the display.

7. The printer according to claim 5, wherein the platen roller and the printing portion are configured such that the print medium is inserted between the platen roller and the printing portion, the plurality of the heating elements are configured to perform printing on a print surface of the print medium, the display is configured to face the print surface of the print medium discharged from the discharge port, and the opening/closing portion is configured to face a surface opposite to the print surface of the print medium discharged from the discharge port.

8. The printer according to claim 1, wherein the processor is further configured to cause, in a case where the specification of the check range is received, the display to display, an image that shows a check element and another image that shows a non-check element, in different colors, the first image including the image that shows the check element and the another image that shows the non-check element, the check element being the heating element in the check range, and the non-check element being the heating element outside the check range.

9. The printer according to claim 1, wherein the causing the display to display the first image includes causing, in response to receiving a specific command, the display to display a check range image in the first image based on a starting point and an end point of the check range, the check range image being an image that shows the check range, a first initial value of the starting point is one, the starting point of the first initial value indicating the heating element at a head end in the main scanning direction, and a second initial value of the end point is a total number of the plurality of the heating elements, the end point of the second initial value indicating the heating element at a tail end in the main scanning direction.

10. The printer according to claim 9, wherein the processor is further configured to cause, in response to receiving the specific command, the display to display a message that prompts a user to specify the starting point of the check range.

11. The printer according to claim 9, wherein the printer further comprises an operation portion configured to input the specification of the check range to the printer, the operation portion comprising a first key and a second key, and the receiving the specification of the check range includes receiving specification of the starting point of the check range in response to receiving an operation of at least one of the first key and the second key.

12. The printer according to claim 11, wherein the operation portion further comprises a third key, and the receiving the specification of the check range further includes confirming the specified starting point of the check range in response to receiving an operation of the third key.

13. The printer according to claim 12, wherein the processor is further configured to cause, in response to receiving the third key, the display to display a message that prompts a user to specify the end point of the check range.

14. The printer according to claim 12, wherein the receiving the specification of the check range further includes receiving specification of the end point of the check range in response to receiving an operation of at least one of the first key and the second key.

15. The printer according to claim 14, wherein the receiving the specification of the check range further includes confirming the specified end point of the check range in response to receiving an operation of the third key.

16. The printer according to claim 15, wherein the processor is further configured to cause, in response to receiving the operation of the third key, the display to display a message that prompts a user to instruct a start of checking the state of the heating element included in the check range.

* * * * *